US005576701A

United States Patent [19]

Heitschel et al.

[11] Patent Number: 5,576,701

[45] Date of Patent: Nov. 19, 1996

[54] REMOTE ACTUATING APPARATUS COMPRISING KEYPAD CONTROLLED TRANSMITTER

[75] Inventors: Carl T. Heitschel, Downers Grove; Colin B. Willmott, Buffalo Grove, both of Ill.

[73] Assignee: The Chamberlain Group, Inc., Elmhurst, Ill.

[21] Appl. No.: 465,605

[22] Filed: Jun. 5, 1995

Related U.S. Application Data

[63] Continuation of Ser. No. 376,058, Jan. 20, 1995, abandoned, which is a continuation of Ser. No. 224,988, Apr. 8, 1994, abandoned, which is a continuation of Ser. No. 939,407, Sep. 1, 1992, abandoned, which is a continuation of Ser. No. 626,909, Dec. 13, 1990, abandoned, which is a continuation-in-part of Ser. No. 552,769, Jul. 16, 1990, abandoned.

[51] Int. Cl.[6] ..... H01Q 1/00

[52] U.S. Cl. ..... 340/825.310; 340/538; 340/825.69

[58] Field of Search ..... 340/825.31, 825.32, 340/825.69, 825.73, 825.34, 538; 341/176; 49/25

[56] References Cited

U.S. PATENT DOCUMENTS

| | | | |
|---|---|---|---|
| 3,926,021 | 12/1975 | Genest | 340/825.31 |
| 4,283,710 | 8/1981 | Genest | 340/506 |
| 4,464,651 | 8/1984 | Duhame | 340/825.69 |
| 4,644,347 | 2/1987 | Lucas et al. | 340/825.44 |
| 4,750,118 | 6/1988 | Heitschel | 364/400 |
| 4,755,792 | 7/1988 | Pezzolo et al. | 340/538 |

FOREIGN PATENT DOCUMENTS

| | | | |
|---|---|---|---|
| 0099762 | 2/1984 | European Pat. Off. | E05B 49/00 |
| 0143309 | 5/1985 | European Pat. Off. | E05B 49/00 |
| 0212050 | 3/1987 | European Pat. Off. | E05B 49/00 |

*Primary Examiner*—Brian Zimmerman
*Attorney, Agent, or Firm*—Fitch, Even, Tabin & Flannery

[57] ABSTRACT

A door actuating system including a keypad type remote transmitter having a keypad for transmitting door open request signals generated by pressing the keys of the keypad and a stored code type remote transmitter, including a code stored in long-term storage for transmitting door open requests including the stored code. A receiver selectively opens the door responsive to the door open requests from both types of remote transmitters. The receiver includes a user settable security switch which inhibits selective door actuation responsive to door open request signals from the stored code type transmitter while permitting selective door actuation responsive to door open request signals from keypad type transmitters.

10 Claims, 5 Drawing Sheets

REMOTE ACTUATING APPARATUS COMPRISING KEYPAD CONTROLLED TRANSMITTER

This application is a continuation of application Ser. No. 08/376,058 filed Jan. 20, 1995 now abandoned, which is a continuation of application Ser. No. 08/224,988, filed Apr. 8, 1994, now abandoned, which is a continuation of application Ser. No. 07/939,407, filed Sep. 1, 1992 now abandoned, which is a continuation of application Ser. No. 07/626,909, filed Dec. 13, 1990 now abandoned, which is a continuation of application Ser. No. 07/552,769.

BACKGROUND OF THE INVENTION

The present invention relates to remote actuating apparatus capable of responding to multiple types of security codes including security codes generated from storage at a transmitter and from keypad generation at a transmitter.

Remote actuating apparatus such as automatic garage door openers comprise remote transmitters and a receiver which responds to signals from the transmitters to generating actuating signals thereby opening a door. The receivers of such arrangements provide security in their operation by actuating only when a properly transmitted request is received which matches one of the small number of allowable security codes. The security codes are used to deny access by miscreants and to limit the possibility that someone with a similar transmitter would erroneously open garage doors other than his or her own.

Two basic types of security code transmitters are known in the art. One type disclosed in U.S. Pat. No. 4,750,118 to C. Heitschel, et al., includes an arrangement which stores a security code on a long term or permanent basis and which transmits the stored security code in response to the pressing of a transmit push-button switch. The long term storage of the security code can be provided by a computer-type memory within the transmitter or by a set of switches within the transmitter which are only rarely changed. The stored code type of transmitter is extremely easy to use since it requires only the pressing of a transmit button. The security of such an arrangement is also good, given the large number of possible security codes that are provided for with today's remote actuation equipment. However, the code of the stored code-type transmitters remains with the transmitter and should the transmitter be lost or stolen, others can actuate the receiver with which it is paired by merely pressing a transmit button.

The second basic type of code transmitter does not include long term security code storage, but instead, includes a keypad which the user manipulates to define a particular security code which the user has memorized. In essence, the long term storage of the transmitter is replaced with human memory. Thus, the keypad-type transmitter can only be used to open a door by people knowing the proper code to enter. Should a keypad-type transmitter be lost or stolen, it includes no memory of the security code to be used and thus, an individual who comes into possession of the transmitter without the owner's permission cannot automatically control a receiver. Keypad transmitters, however, are much less convenient to use than stored code transmitters because the code must be remembered and re-entered for each use of the keypad transmitter. Also, when a user's arms are full of packages or when the user is driving a car, keypad code entry can be physically difficult.

A need exists for a door actuation arrangement which provides the security against loss or theft of a keypad transmitter while retaining the ease of use of a stored code transmitter.

SUMMARY OF THE INVENTION

A garage door opening system in accordance with the present invention comprises a door actuating apparatus which responds to door open request signals from remote transmitters of a keypad type and from remote transmitters of the long-term storage type by selectively opening a garage door. Advantageously, an operator controlled security switch is included at the door actuating apparatus which enables the operator to lock out the stored code type door open requests, while permitting keypad type door open requests to selectively open the door.

For normal operation, the actuation apparatus opens the door and responds to both types of door open requests. However, when greater security is desired, such as when a stored code type transmitters is lost or stolen, the security switch setting can be changed to lock out the stored code type transmitter. During the time that the stored code type transmitter is locked out, operation by the keypad type transmitter is still permitted. When greater security is no longer needed, e.g., the lost transmitter is found, controlling the security switch again permits door actuation by both types of remote transmitters. In an embodiment of the invention, the door actuation apparatus can also be controlled to inhibit all door actuation, regardless of the type of the door open request signals received.

Each type of door open request includes a security code sequence which is distinguishable from the security code sequence of the other types of door open requests. The actuating apparatus includes a memory for storing permitted security code sequences of both the keypad type and the stored code type. The permitted code sequences are those which are permitted to open the door. In response to a received door open request, the door actuating apparatus determines the type of received request and compares the security code of the received request with the same type of stored permitted code sequence. When the compared code sequences are the same, a door actuation signal is generated. The door actuation signal generated in response to a received stored code type door open request may be inhibited by the setting of the security switch.

For even greater utility, a door opening apparatus in accordance with the present invention can respond to two formats of stored code type security signals and to the keypad type security signals. The actuation apparatus comprises memory for storing at least one permitted stored code of all three possible types of received door open requests. When a door open request is received, its type and format are determined and it is compared with the same type of stored permitted code sequence. When the compared code sequences are the same, door actuation signals are generated. When the security switch is controlled to be in the increased security mode, door actuation signals responsive to both types of stored security code transmitters are inhibited, while those of a keypad transmitter are not.

DETAILED DESCRIPTION OF THE PREFERRED EMBODIMENT

Figure 1:
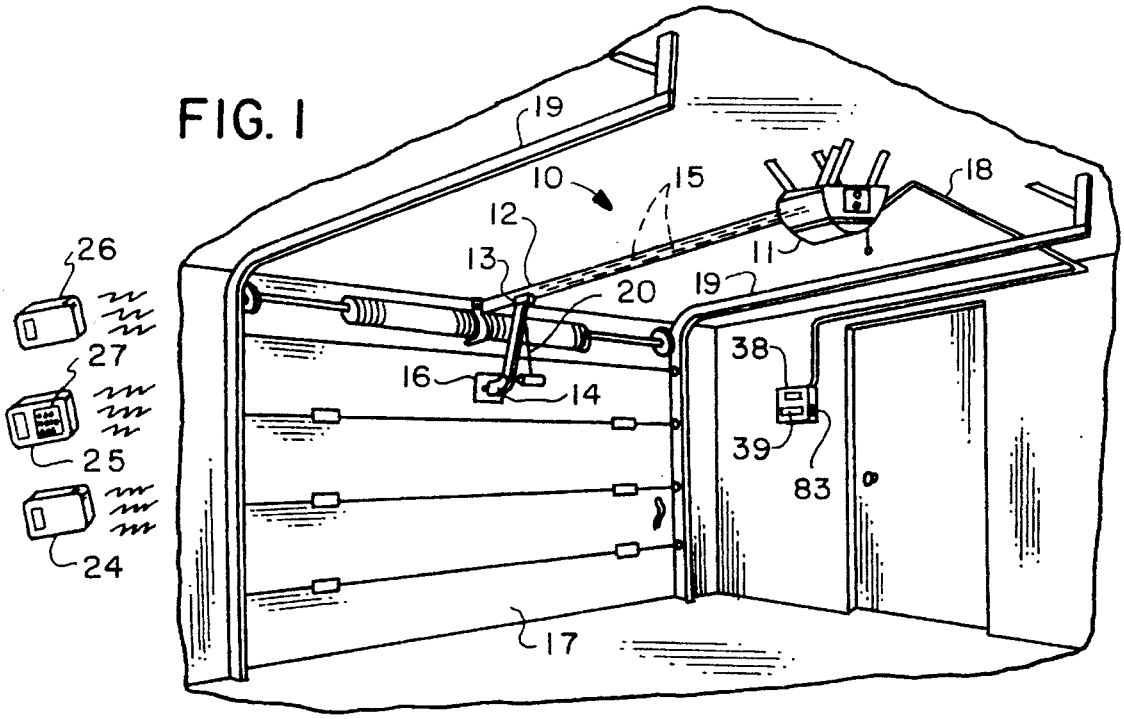
FIG. 1 is a perspective view showing a garage door operator embodying various features of the present invention.

FIG. 1 illustrates a garage door operator 10 mounted to the ceiling of a garage and connected to operate a door 17. Garage door operator 10 has a head end unit 11 which is supported from the ceiling and includes a motor (not shown) which drives a suitable chain 15 to which a trolley 13 is attached so that it moves along rail 12. The trolley 13 has a release cord 20 and pivotally carries a lever arm 14 which is attached to a bracket 16 mounted to the door, so as to raise and open it by pulling along conventional rails 19. Similarly, head end unit 11 lowers the door by moving trolley 13 away from the head end unit 11 until the door has achieved the closed position.

Head end unit 11 includes an operating mechanism which energizes the motor to open and close the door. The operating mechanism is actuated in response to an actuation signal transmitted over a conductor 18 from a control unit 38. Control unit 38 generates the actuation signal on conductor 18 in response to an operate switch 39 on the control unit 38 and in response to door actuation request signals from remote transmitters 24 through 26. The door actuation request signals from remote transmitters 24 through 26, each comprise a sequence of code words which must match a sequence of allowable code words stored in controlled unit 38 before actuation signals are generated on conductor 18. In the present embodiment, remote transmitters 24 and 25 transmit in a 10 code word format in which each door actuation request signal includes 10 code words and remote transmitter 26 transmits in a 20 code word format in which each door actuation request signal includes 20 code words.

Figure 2:
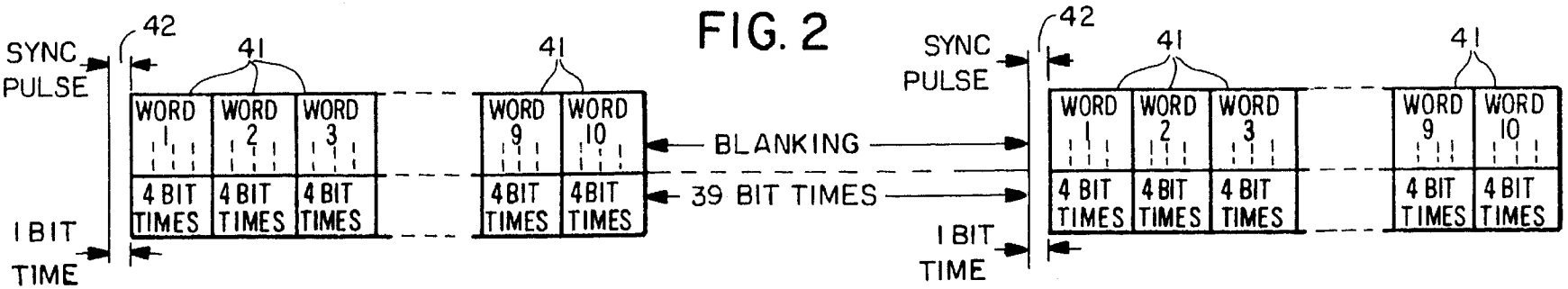
FIG. 2 represents a ten code word security format used with the garage door operator of FIG. 1.

FIG. 2 represents a door actuation request signal of the 10 code word format in which ten code words 41 make up the security code proper. Each of the code words 41 comprises 4-bits which are used to convey one of three code designations. The coding of these three designations, which are labelled A, B and C is shown in Table 1. Since each of the code words 41 indicates one of three states and ten such words exist in a code sequence, approximately 59,000 unique code word sequences can be created with the 10 code word coding format.

TABLE 1

CODE WORD REPRESENTATIONS

| Code Character | Transmitted Code Bit-1 | Bit-2 | Bit-3 | Bit-4 |
|---|---|---|---|---|
| A | 0 | 0 | 0 | 1 |
| B | 0 | 0 | 1 | 1 |
| C | 0 | 1 | 1 | 1 |

The code words are transmitted from a transmitter to a control unit 38 using RF signals and each sequence of code words begins with a single logic one synchronization pulse 42 (FIG. 2). After the transmission of a complete ten word code sequence, a blanking interval is produced by the transmitter of approximately 39-bit intervals, then the entire code sequence beginning with the logic one synchronization pulse 42, is repeated. Transmission in this manner results in a continuing sequence of transmitted 10 word code sequences, each separated by 39 blank bit times and each beginning with a logic one synchronization pulse 42. Control unit 38 recognizes the 10 code word format recognizes the format by the presence of the one bit time synchronization pulse 42 following a blanking interval and records each successive sequence of ten code words. As is well known in the art, multiple repetitions of the same code word sequence are received before the code word sequence is determined to have been received correctly.

Figure 3:
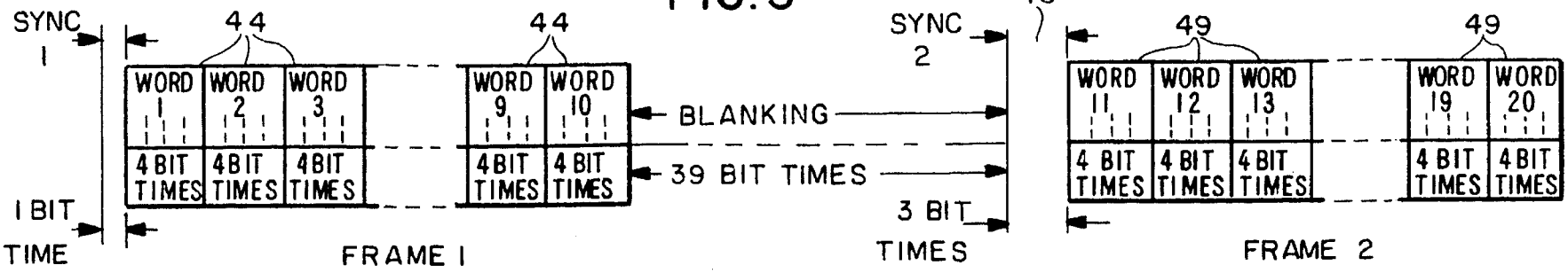
FIG. 3 represents a twenty code word security format used with the garage door operator of FIG. 1.

FIG. 3 represents a 20 code word sequence of the present embodiment. The 20 code word sequence of FIG. 3 comprises two frames of code words where a frame 1 consists of code words 1 through 10 and a frame 2 consists of code words 11 through 20. The code words of frame 1 are denoted 44 and those of frame 2 are denoted 45. A code sequence of 20 three state code words as shown in FIG. 3 permits in excess of three billion unique code combinations.

20 code word sequences are transmitted in a manner different from the 10 code word sequences. Each frame 1 is transmitted using substantially the same format as each frame of the 10 code word system and begins with a logic one synchronization pulse 42 and ends with a blanking interval of approximately 39-bit times. Each frame 2, however, is transmitted at the end of the blanking interval and begins with a synchronization 2 signal 46 which comprises three consecutive logic ones. At the conclusion of the transmission of a frame 2, another blanking interval is enforced followed by repetitive transmissions of frame 1 and frame 2, each separated by a blanking interval and each frame 2 beginning with a 3-bit synchronization signal 46.

Regardless of whether a 10 or 20 code word format is used by a given transmitter, the code words of the format must be accurately produced by that transmitter. The code word sequence to be transmitted is stored in a memory in transmitters 24 and 26, while the code word sequence transmitted by transmitter 25 is entered by user manipulation of a push button keys 27 (FIG. 1).

Figure 4:
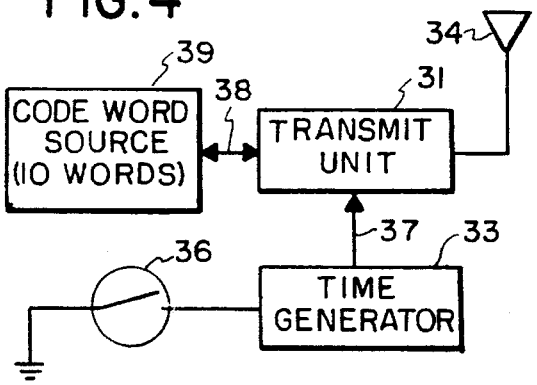
FIG. 4 is a block diagram of a stored code type ten code word transmitter for use with the operator of FIG. 1.

FIG. 4 is a block diagram of a transmitter 24 which transmits pre-stored code words in the ten code word format. In FIG. 4, a transmit unit 31 operates in accordance with signals from a time generator 33 to read the ten permanently stored code words from a code word source 39 and convert them into RF signal bursts which are transmitted to the control unit 38 (FIG. 1) via an antenna 34. The transmitter of FIG. 4 is normally at rest. When an operator wishes to transmit a code, that operator presses push button 36 to which timing generator 33 responds by generating a continuing sequence of clock pulses at the rate of approximately one pulse per millisecond. These clock pulses are applied to transmit unit 31 via a conductor 37 and control the reading of the ten code words from code word source 39 and their transmission in the ten code word format from antenna 34. Code word source 39 is a memory which permanently stores the ten code words in the format shown in Table 1. In order to facilitate identification of the source of transmitted code word sequences, the tenth code word stored by code word source 39 is always a code character "A" as shown in Table 1.

In order to control the minimum number of times that the code sequence is transmitted, time generator 33 may include a delay device such as a monostable multi-vibrator (not shown) which keeps timing generator 33 operational for a predetermined period of time regardless of the time that the button 36 is actually held down. Such preset operation of timing generator 33 assures that a minimum number of code word sequences is transmitted for each push of button 36.

Figure 5:
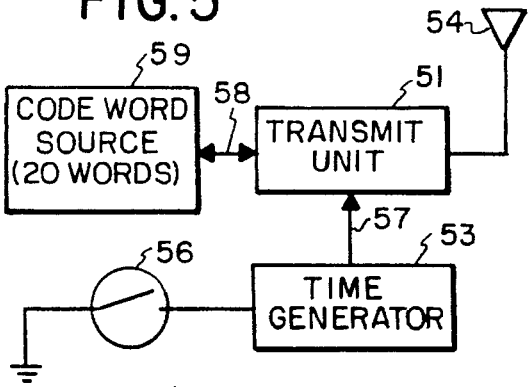
FIG. 5 is a block diagram of a twenty code word stored code type transmitter.
Figure 6:
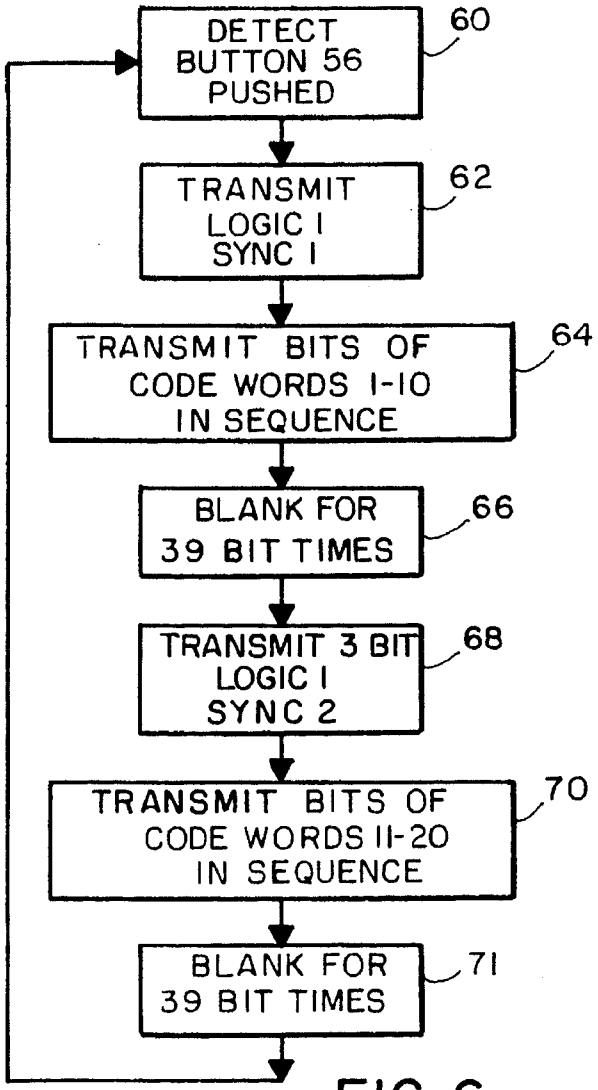
FIG. 6 is a flow diagram of the operation of the transmitter of FIG. 5.

FIG. 5 is a block diagram representation of a transmitter 26 for transmitting 20 code word sequences of the type shown in FIG. 3. A transmit unit 51 operates in accordance with signals from a time generator 53 to read permanently stored code words from a code word source 59 and convert them into RF signal bursts which are transmitted to the control unit 38 (FIG. 1) via an antenna 54. The transmitter of FIG. 5 is normally at rest. When an operator wishes to transmit a code, that operator presses a push-button 56 to which timing generator 53 responds by generating a continuing sequence of clock pulses at the rate of approximately one pulse per millisecond. These clock pulses are applied to transmit unit 51 via a conductor 57 and control the reading and transmission of code words. FIG. 6 is a flow diagram of the operation of the transmitter of FIG. 5 and is discussed in conjunction with the operation of the transmitter of FIG. 5.

The sequence shown in FIG. 6 begins at block 60 with the detection of the closure of push-button 56. Pressing button 56 causes time generator 53 to generate a recurring sequence of timing pulses at the rate of one per millisecond. In response to a first timing pulse, transmit unit 51 transmits via antenna 54, a logic one, synchronization 1 signal of 1-bit time duration (one millisecond). At this time, transmit unit 51 also begins to read code words from a code word source 59 over a communication path 58. In block 64, the code words read from code word source 59 are transmitted in sequence at the rate of 1 code word bit per clock time until the last bit of the tenth code word has been transmitted. At the end of transmission of the tenth code word, transmit unit 51 blanks all transmission for 39 bit times (block 66).

Transmitter 51 terminates the blanking interval by transmitting a synchronization 2 signal consisting of three consecutive logic ones (block 68). At the conclusion of the transmission of the synchronization 2 signal, code words 11 through 20 which are accessed from code word source 59 are transmitted in a manner substantially identical to the transmission of code words 1 through 10. At the conclusion of the transmission of code words 11 through 20, the flow diagram proceeds to block 71 where another blank interval of 39-bit times is inserted and the flow proceeds back to block 60 where a determination is made of the state of push-button 56. If push-button 56 is still closed, the sequence 60 through 71 repeats itself. Since the time required to transmit both code word frames 1 and 2, and both blanking intervals is only 182-bit times (182 milliseconds), normal human interaction with push-button 56 results in multiple transmissions of the entire 20 code word code sequence. In order to control the minimum number of times that the code sequence is transmitted, time generator 53 may include a delay device, such a mono-stable multi-vibrator (not shown) which keeps timing generator 53 operational for a predetermined period of time, regardless of the time the button 56 is actually held down. Such preset operation of timing generator 53 assures that a minimum number of code word sequences is transmitted for each push of button 56.

In the present embodiment, code word source 59 comprises a memory storing the 4-bit codes of the type shown in Table 1. Since twenty 3-state code words are used in the present embodiment, in excess of three billion possible codes are represented. With such a large number of possible codes, the code word sequences of all transmitters can be virtually guaranteed to be distinct.

Figure 7:
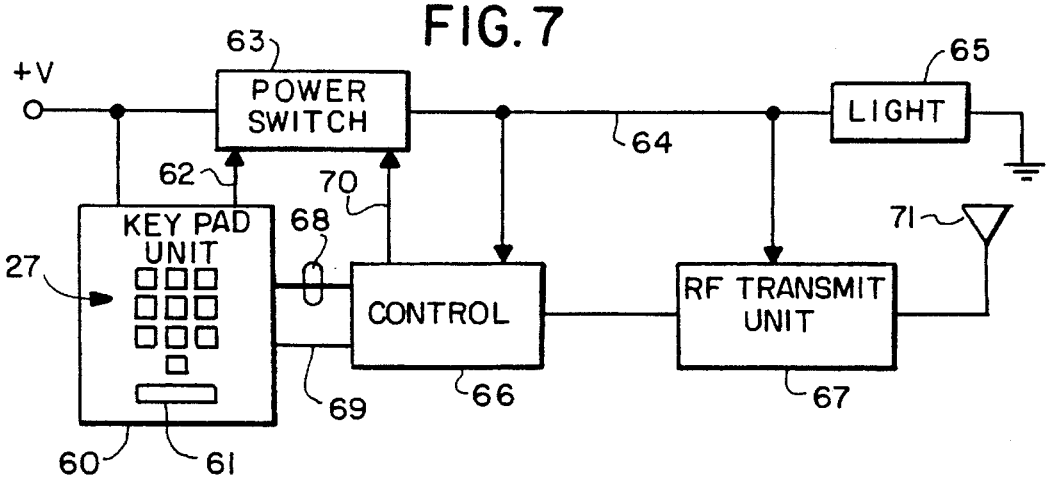
FIG. 7 is a block diagram of a keypad type transmitter used with the operator of FIG. 1.

Keypad transmitter 25 which is shown in block diagram form in FIG. 7 does not include long term storage of a security code, but briefly registers 10 code words derived from four number key 27 presses. The registered code words are transmitted if a transmit key 61 is pressed within a short period (10 to 20 seconds) of time after the first number key is pressed. When the four keys of the code and the transmit key are not pressed within the short period of time, the registered code words are made unavailable (erased) so that no keypad transmitter finder or thief can use transmitter stored information to gain access to a protected door. The time of code word registration, i.e., 10–20 seconds, is kept brief to provide little more than enough time for a slow operator to enter and transmit a code sequence.

Figure 8:
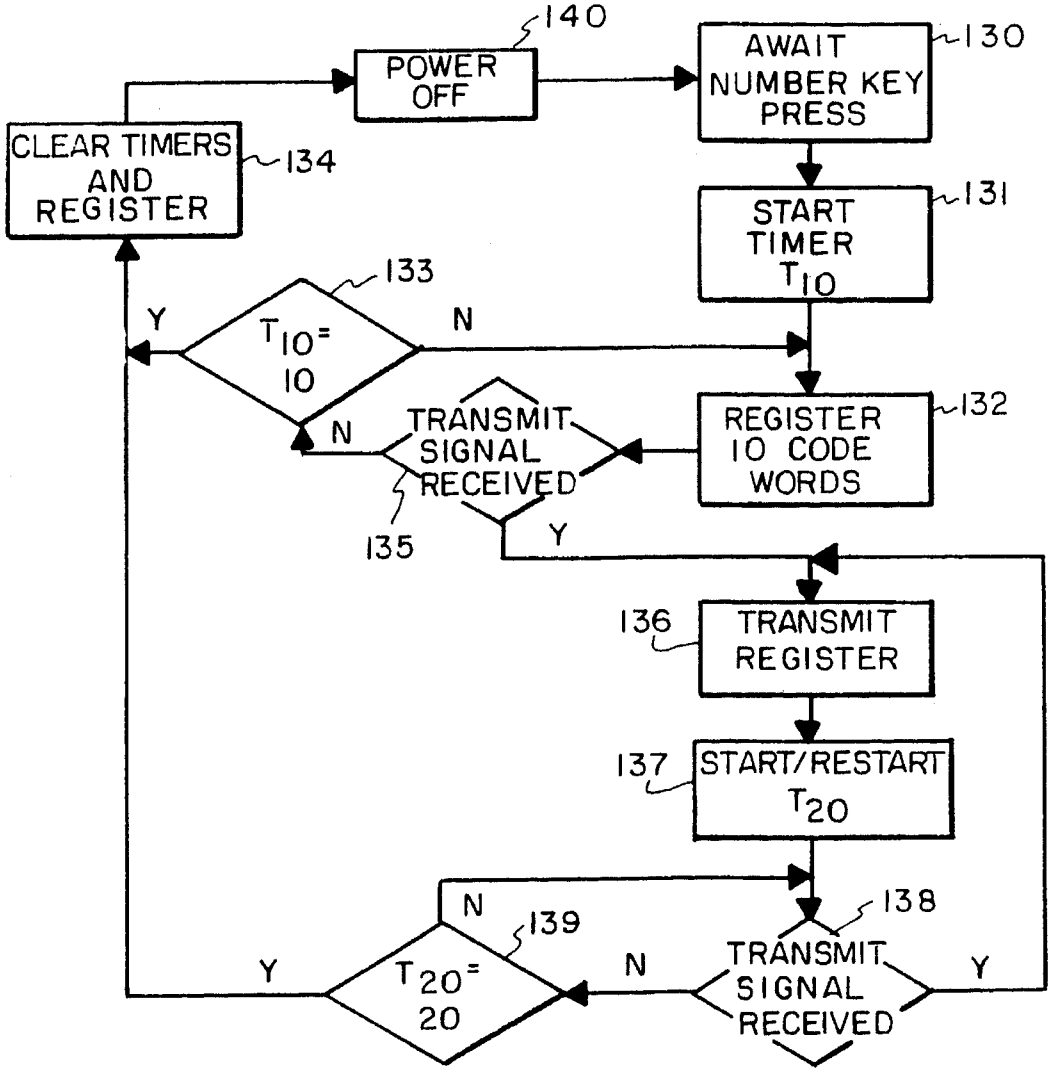
FIG. 8 is a flow diagram of the operation of the transmitter of FIG. 7.

The transmitter 25 shown in FIG. 7 is now described in conjunction with the flow diagram of FIG. 8. The transmitter 25 includes a keypad unit 60 having ten number keys 27 and a transmit key 61. The transmitter of FIG. 7 normally is awaiting the press of a number key and in this waiting mode (block 130, FIG. 8), only the keypad unit 60 is receiving power input. When a keypad number key 27 is pressed, a signal is sent on conductor 62 to a power switch 63 which then applies power via a conductor 64 to a light 65, a controller 66 and an RF transmitter 67. Light 65, which may comprise a plurality of light emitting diodes, produces a light when it receives power on conductor 64 to indicate to the operator that at least a partial security code sequence is registered in the transmitter 25. Keypad unit 60 also responds to the press of a number key 27 by transmitting a four-digit binary code representation of the particular key pressed to control 66 via a communication path 68. The four-digit binary code consisting of all zeros is not used to represent any key so that all number key representations include at least a single logic 1.

When control 66 receives a representation of a first key press from communication path 68, it proceeds to a block 131 where a ten-second timer $T_{10}$ is started. Controller 66 also encodes the received key press representation into the Table 1 format in preparation for transmission to control unit 38. Each key pad entered code consists of four key presses. Each of the four key press representations of a keypad entered code is encoded by control 66 into two code words as shown in Table 2 for a total of eight code words.

TABLE 2

| Received Key Press | Code Words Registered |
|---|---|
| 1 | C and C |
| 2 | A and C |
| 3 | B and C |

TABLE 2-continued

| Received Key Press | Code Words Registered |
|---|---|
| 4 | C and B |
| 5 | A and B |
| 6 | B and B |
| 7 | C and A |
| 8 | A and A |
| 9 | B and A |
| 0 | B and A |

The ninth code word is then selected in accordance with Table 3.

TABLE 3

| 9th Code Word | IF |
|---|---|
| A | Key 0 not pressed |
| B | Key 0 pressed and key 9 not pressed |
| C | Key 0 and 9 both pressed |

The tenth code word registered for all keypad type transmitter code word sequences is selected at the time of manufacture to be one of code words "B" or "C", that is, some keypad transmitters 25 will always register a code word "B" as the tenth code word and other keypad transmitters will always register a code "C" as the tenth code word. However, no keypad transmitter 25 will register a code word "A" as the tenth code word.

As each key press representation is received by control 66, it is encoded and registered (block 132, FIG. 8) until ten code words are registered. The operator, at the completion of pressing the four keypad keys 27 of a code, presses the transmit key 61 causing a transmit signal to be sent to controller 66 via conductor 69. The registration of code words and the receipt of a transmit signal are timed (block 133) by the previously set timer $T_{10}$. If the ten code words are not registered and the transmit signal not received within approximately ten seconds of the setting of timer $T_{10}$, the flow proceeds from block 133 to a block 134 where timers such as timer $T_{10}$ are cleared and the registered code words are made unavailable (erased). After block 134, control 66 transmits a signal (block 140) on a conductor 70 (FIG. 7) to which power switch 63 responds by removing the power from conductor 64.

When the transmit signal on conductors 69 is received (block 135) within ten seconds of the start of timer $T_{10}$ and all ten code words are registered, control 66 sends (block 136) the registered code words to the RF transmitter 67 which transmits them to control unit 38 via antenna 71. At this time, a timer $T_{20}$ is started (block 137). Whenever the transmit button 61 is pressed (block 138) within 20 seconds of starting timer $T_{20}$, the code word sequence is again transmitted (block 136) and the timer $T_{20}$ is restarted (block 137). Should more than 20 seconds pass after the starting or restarting of timer $T_{20}$, the negative branch of a timer loop 139 is taken and the registered code words are made unavailable (block 134) and power is turned off (block 140).

The three types of transmitters 24 (FIG. 4), 25 (FIG. 7) and 26 (FIG. 5), each transmit a door request signal which identifies the type of transmitter sending the request. Transmitter 26 transmits in the 20 code word format (FIG. 3), which can be identified by the synchronization 2 signal 46. Transmitter 24 transmits in the 10 code word format (FIG. 2) and identifies its type by the fact that code word 10 is always a code character "A" (Table 1). Transmitter 25 also transmits in the 10 code word format and identifies its type by the fact that the code word 10 is always a character "B" or "C" (Table 1), never a code character "A".

The code word sequences transmitted from the transmitters of FIGS. 4, 5 and 7 are received by an antenna 74 of the control unit 38 (FIG. 9) and conveyed to an RF receiver 73. Receiver 73 conveys the received signals to a decoder 76 which converts them to the binary format shown in Table 1 and applies them to a receiver controller 78. Controller 78 identifies the transmitter type and compares the received codes with permitted codes stored in a memory 79 for the received transmitter type. When a match is found, controller 78 enables door apparatus 11 via conductor 18. The permitted codes stored in memory 79 for each type of transmitter are recorded therein during a receiver programming mode which is initiated by the press of a program switch push-button 84.

Control unit 38 also includes a security switch 83 which is connected to controller 78 and used to modify the response of controller 78 to received codes. When security switch 83 is a first position 151, controller 78 responds to received codes from all types of transmitters 24, 25 and 26 and generates actuation signals on conductor 18 when matching security codes occur. However, when security switch 83 is a second position 152, controller 78 responds only to received code sequences from keypad transmitters 25. Thus, the security switch 83 allows the system owner to control which type of transmitter can actuate the door. For example, if a transmitter (24, 26) of the stored code type is lost or stolen, the owner can place security switch 83 in the second position and thereby permit entry only to those individuals who know the proper keypad code.

Figure 10:
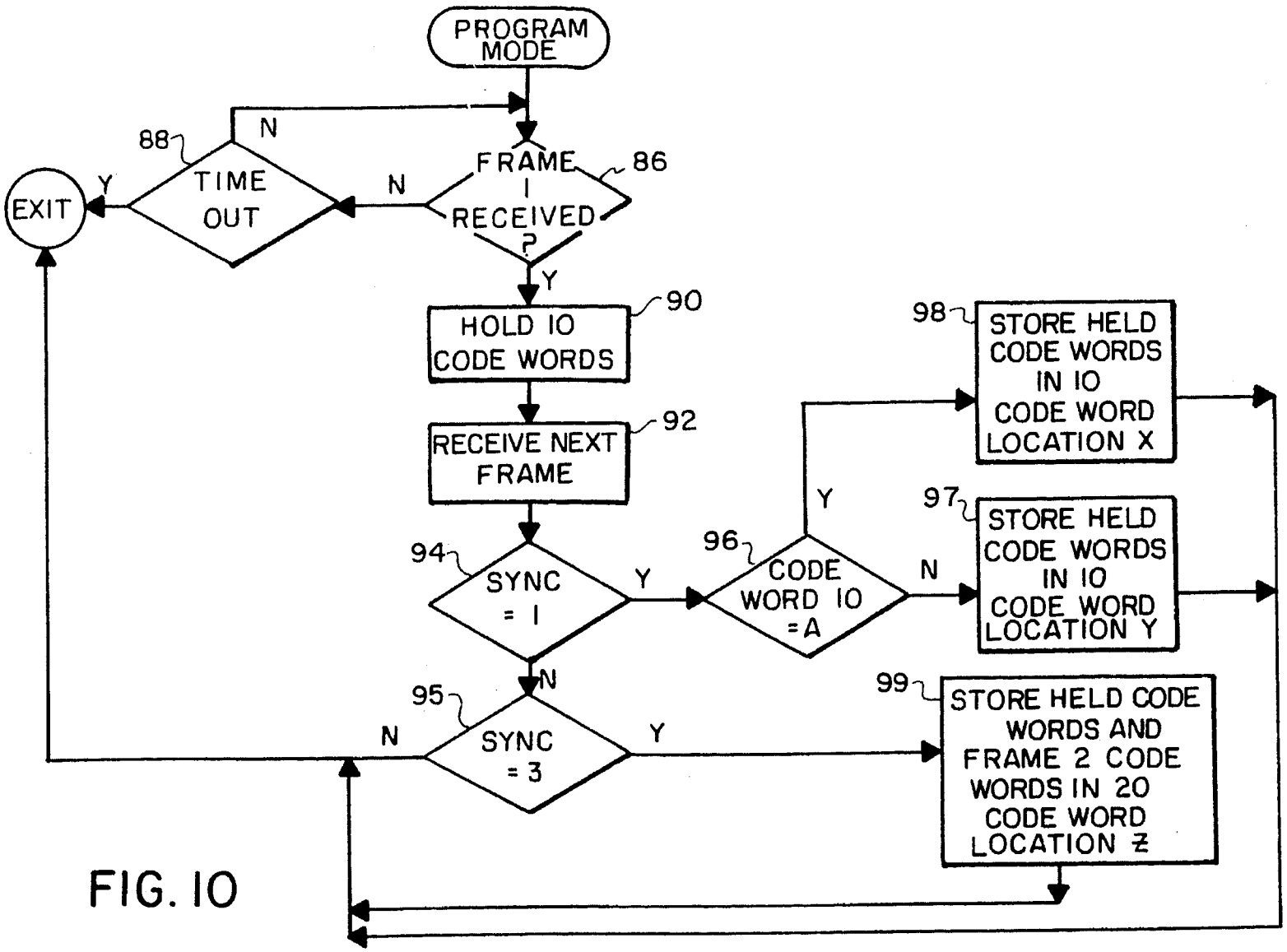
FIG. 10 is a flow diagram showing a programming mode of operation for the transmitter of FIG. 9.

Pressing program switch 84 puts controller 78 in the programming mode shown in the flow diagram of FIG. 10. In the programming mode, the transmitter or transmitters to be used with the subject receiver can be individually enabled to transmit their respective security codes to the control unit 38 which receives those security codes and stores them as permitted codes in memory 79. When program switch 84 is initially depressed, controller 78 enters block 86 (FIG. 10) where it awaits the reception of a first frame 1 of code words from decoder 76. Controller 78 determines in block 86 that a frame 1 is received by analyzing the number of bits in the received synchronization signal. It should be mentioned that either a frame one of the 20 code word format (FIG. 3) or any frame of the 10 code word format (FIG. 2) is determined in block 86 to be a frame 1. When no frame 1 is received within a period of time determined in block 88, the controller exits the program mode and returns to a mode of awaiting an incoming code for door actuation purposes. If 3-bits are received in block 86 as the synchronization signal, a frame 2 was actually received and the flow returns to the beginning to await a frame 1.

When a frame 1 is received in block 86, the ten code words of that frame are held in storage in block 90 and the immediately subsequent frame is received in block 92. After a next frame is received in block 92, the flow proceeds to block 94 to determine if the synchronization signal received in block 92 comprises a single logic one. When the received synchronization signal comprises a single logic one, then a 10 code word sequence is being received and the flow proceeds to block 96. In block 96, code word 10 is checked to identify whether the incoming code sequence is of the stored code transmitter 24 type (FIG. 4) in which code word 10 equals the code character "A" (Table 1) or of the keypad transmitter 25 type (FIG. 7) in which code word 10 does not equal the code character "A". When block 96 determines that code word 10 does not equal the code character "A", the flow proceeds to block 97 where the 10 code word sequence is stored in a location Y of memory 79 allocated to permitted 10 code word sequences from keypad type transmitters 25. Alternatively, when block 96 determines that code word 10 equals the code character "A" the flow proceeds to block 98 where the received 10 code word sequence is stored in a location X of memory 79, allocated to permitted 10 code word sequences from stored code type transmitters 24. After the storage of the received 10 code word sequence in either step 97 or 98, control unit 78 exits the program mode.

When the performance of block 94 indicates that the received synchronization signal does not contain a single logic one, a block 95 is performed to determine if the synchronization signal comprises three logic ones. A synchronization code of 3 logic ones indicates the reception of a frame 2 of code words 11 through 20. When the received synchronization signal does not comprise three logic ones, the program mode is exited. However, when block 95 determines that the synchronization signal comprises three logic ones the code word sequence comprising the ten code words 1 through 10 held in block 90 and the newly received ten code words 11 through 20 are stored (block 99) in a location Z of memory 79 which is allocated to the storage of permitted twenty code word sequences. After the storage (block 99) of the two-frame code word sequence in memory 79, the program mode is again exited.

Entering the program mode a number of times with different transmitters permits the storage of a number of possible permitted code words in memory 79. The present embodiment allows the storage of one-ten code word sequence of stored code transmitter type, one-ten code word sequence of keypad transmitter type and four-twenty code word sequences.

It should be mentioned that FIG. 10 shows the receipt of the code sequences only once before they are stored in memory 79. It may be desirable to require that an incoming code sequence be received multiple times before it is stored as a permitted sequence. An arrangement for requiring multiple valid code sequences in a substantially similar environment as described in detail in the aforementioned C. Heitschel, et al., patent.

Figure 9:
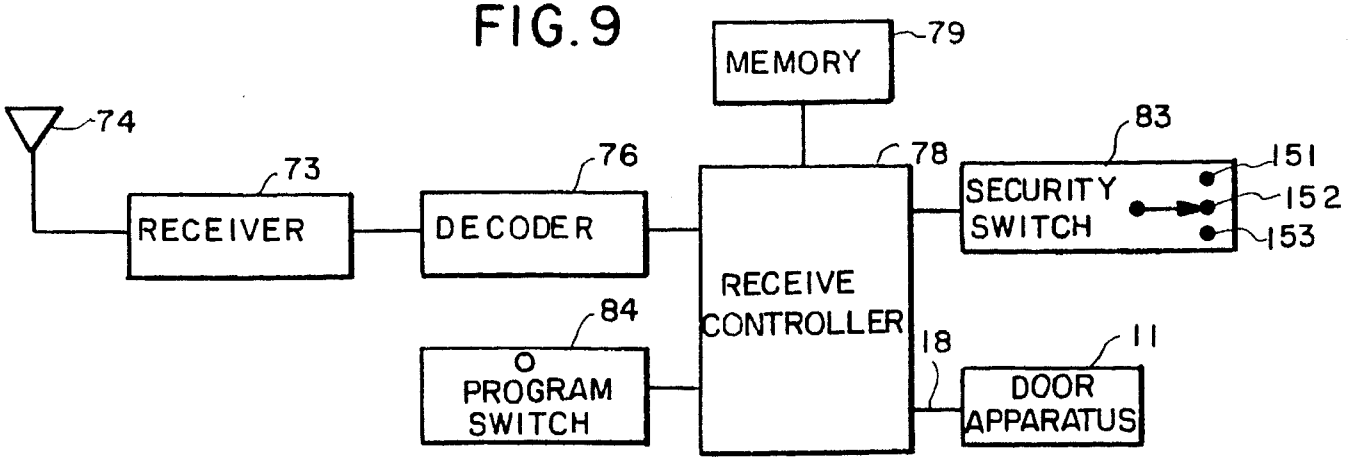
FIG. 9 is a block diagram of a control unit of the operator of FIG. 1.
Figure 11:
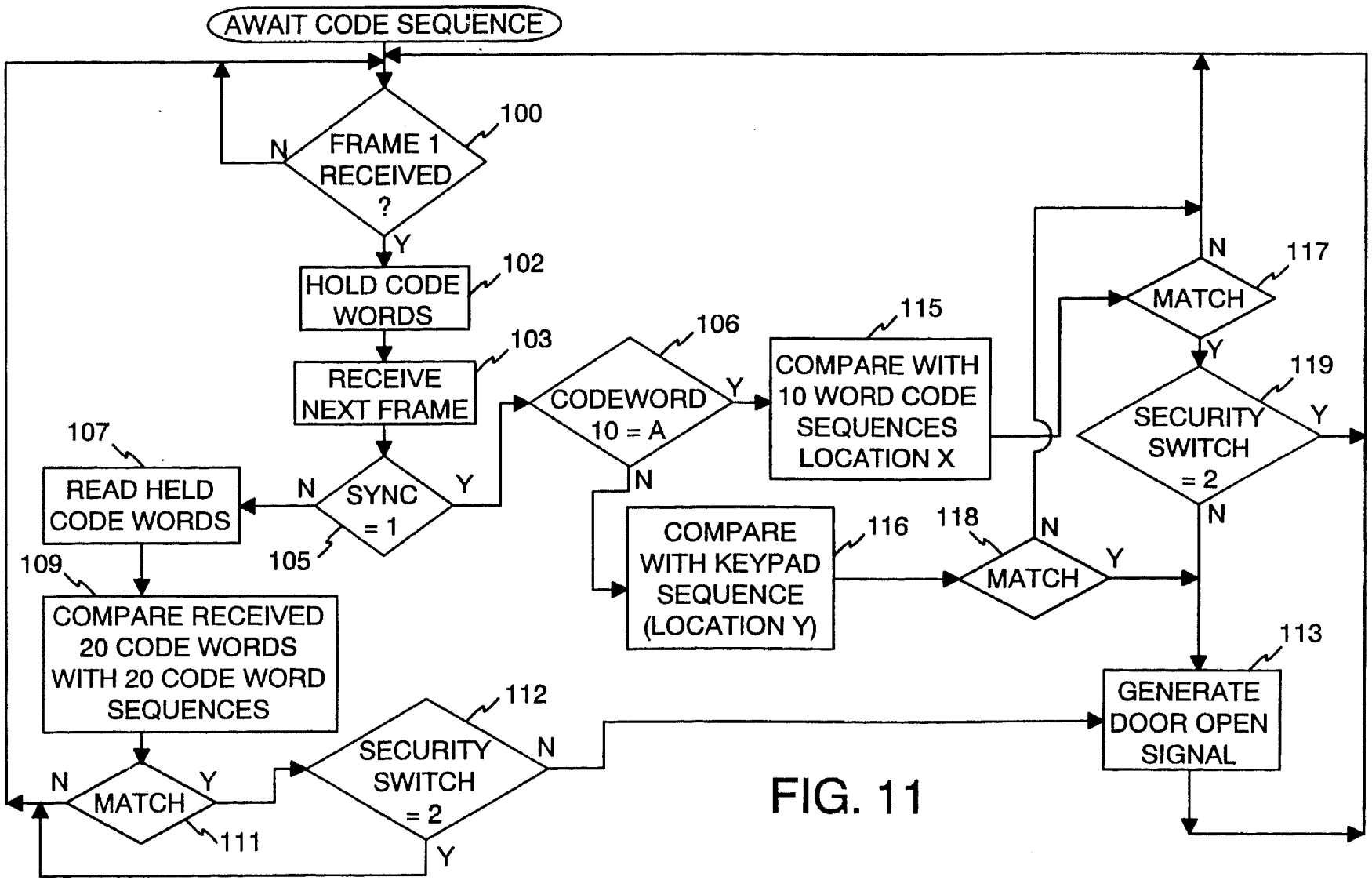
FIG. 11 is a flow diagram showing the response of the control unit to received security codes.

FIG. 11 is a flow diagram of the normal operation of the controller 78 of FIG. 9 in which the controller 78 awaits an incoming code sequence for possible door actuation. This mode begins at block 100 where a valid frame one is awaited. When a valid frame 1 is received in block 100, flow proceeds to a block 102 where the 10 code words received are temporarily stored and the flow proceeds to a block 103 awaiting the next received frame. Block 105 is performed after a next frame is received to determine if the received frame is a frame 2 or a second occurrence of frame 1. The distinction is made by an evaluation of the length of the synchronization signal. When the synchronization signal indicates in block 105 that a frame 2 has been received the code words held in block 102 are read in block 107 and the twenty code words comprising the received frame 1 and frame 2 are compared (block 109) with the permitted twenty code word sequences stored in location Z of memory 79. Matches between received 20 code word sequences and stored permitted 20 code word sequences are identified in block 111. When block 111 determines that the received 20 code word sequence does not match a stored permitted 20 code word sequence, control returns to block 100 to await the reception of a new frame 1. Alternatively, when a match is determined in block 111 between the received 20 code word sequence and a stored permitted 20 code word sequence, flow proceeds to a block 112 where the state of the security switch 83 is checked. When the security switch 83 is in its second position (called position 2), indicating that only keypad type codes are permitted to open the door, the flow proceeds from block 112 to block 100 to await the reception of a new frame 1. In normal operation, however, security switch 83 will be in its first position indicating that all types of codes are permitted to open the door. When block 112 determines that security switch is in the first position (not in position 2), flow proceeds to a block 113 where an actuation signal is generated to open the door. After generation of the actuation signal, flow proceeds to block 100 to await the reception of a new frame 1.

When block 105 determines that a second frame 1 has been received after a first frame 1, the tenth code word of the received ten code word sequence is checked in block 106 to determined whether the received code word sequence has a tenth code word equal to the character "A" (Table 1), indicating a stored code type transmitter 24, or a tenth code word equal to the characters "B" or "C" (Table 1) indicating a keypad type transmitter 25. When a keypad type code is identified in block 106, the received code is compared (block 116) with the permitted keypad code stored in location Y of memory 79. When the codes match (block 118), flow proceeds to a block 113 where an actuation signal is generated. The flow proceeds from block 118 to block 100 when no match is detected in block 118.

When block 106 determines that the received ten code word sequence is from a stored code transmitter 24, the ten code words of the received frame 1 are compared (block 115) with the ten code word sequence stored in location X of memory 79. When the compared code sequences do not match (block 117), flow proceeds to block 100. Alternatively, when block 117 determines that the compared code sequences match, flow proceeds to block 119 where the position of the security switch 83 is checked. When security switch 83 is in position 2, flow proceeds to block 100. Alternatively, when block 119 determines that the security switch is in position 1 indicating acceptance of all types of incoming codes, flow proceeds to block 113 where an actuation signal is generated.

In the flow diagram of FIG. 11, the state of security switch 83 is checked in blocks 112 and 119 just prior to the step of generating actuation signals. The placement of the comparison provided by blocks 112 and 119 can be changed to other points within the flow diagram of FIG. 11 without departing from the present invention. In fact, the flow diagram of FIG. 11 could be implemented as two separate flow diagrams, one operational when security switch 83 is in position 1 and the other operational when security switch 83 is in position 2. In the preceding embodiment, a two position security switch is used to indicate control unit responsiveness. A third position 153 of the security switch, or an additional lock out switch (not shown), can be used to disable control unit 38 response to all received door open request signals, regardless of their source.

While preferred embodiments of the invention have been illustrated, it will be obvious to those skilled in the art that various modifications and changes may be made thereto without departing from the scope of the invention set forth in the attached claims.

What is claimed is:

1. A remote garage door opening system for selectively opening a door, comprising:

a keypad transmitter comprising a plurality of keys, for transmitting keypad type door open request signals, each keypad type door open request signal including a keypad type security code word sequence and having keypad transmitter indicia;

a first stored code transmitter, comprising a first code word sequence stored in long-term storage, for transmitting first stored security code type door open request signals, each first stored security code type door open request signal including said first stored code word sequence and having first stored code transmitter indicia distinguishable from said keypad type transmitter indicia;

a second stored code transmitter, comprising a second security code word sequence stored in long-term storage, for transmitting second stored code type door open request signals, each second stored code type door open request signal including said second stored security code word sequence and having a second stored code transmitter indicia distinguishable from said keypad type transmitter indicia and from said first stored code type transmitter indicia;

receive means for receiving said keypad type door open request signals and said first and said second stored code type door open request signals;

determining means responsive to the keypad transmitter indicia of a received keypad type door open request signal for determining that the received door open request signal is a keypad type door open request signal and responsive to the first and second stored code transmitter indicia of a received stored code type door open request signal for determining that the received door open request signal is a stored code type door open request signal;

operator controlled security switch means having a first and a second position; and control means for storing keypad type and stored code type security code sequences, said control means being responsive to said determining means and said security switch means for permitting the selective opening of the door in response to keypad type and both said first and said second stored code type door open request signals which match a stored security code sequence of the same type when said security switch is in the first position, for permitting the selective opening of the door in response to door open request signals which match a stored keypad type security code sequence determined by the determining means to be keypad type door open request signals when said security switch is in the second position and for inhibiting the opening of the door in response to door open request signals determined by the determining means to be either of said first and said second stored code type door open request signals when said security switch is in the second position.

2. A remote garage door opening system for selectively opening a door, comprising:

a keypad transmitter comprising a plurality of keys for transmitting keypad type door open request signals, each keypad type door open request signal including a keypad type security code word sequence and keypad transmitter indicia;

a stored code transmitter, comprising a security code word sequence stored in long-term storage, for transmitting stored code type door open request signals, each stored code type door open request signal including said stored security code word sequence and stored code transmitter indicia distinguishable from said keypad type transmitter indicia;

receive means for receiving said keypad type door open request signals and said stored code type door open request signals;

determining means responsive to the keypad transmitter indicia of a received keypad type door open request signal for determining that the received door open request signal is a keypad type door open request signal and responsive to the stored code transmitter indicia of a received stored code type door open request signal for determining that the received door open request signal is a stored code type door open request signal, operator controlled security switch means having a first and a second position; and control means for storing keypad type and stored code type security code sequences, said control means being responsive to said determining means and said security switch means for permitting the selective opening of the door in response to keypad type and stored code type door open request signals which match a stored security code sequence of the same type when said security switch means is in the first position, for permitting the selective opening of the door only in response to door open request signals determined by the determining means to be keypad type door open request signals which match a stored keypad type security code sequence when said security switch means is in the second position and for inhibiting the opening of the door in response to door open request signals determined by the determining means to be stored code type door open request signals when said security switch means is in the second position.

3. The system of claim 2 wherein said security switch has a third position and said control means responds to said security switch in said third position for inhibiting the opening of said door in response to all received door open request signals.

4. The system of claim 2 wherein said control means comprises:

means for comparing a received keypad type security code sequence with said keypad type security code sequence store din the control means;

means for comparing a received stored code type security code sequence with said stored code type security code sequence stored in the control means;

means for generating door opening signals when one of said comparing means determines that a received security code sequence is the same as a security code sequence stored in the control means; and means responsive to said determining means and said security switch means for inhibiting said door opening signals when said received door open request signal is stored code type door open request signal and said security switch means is in said second position.

5. The system of claim 4 wherein said control means comprises a learning mode and said control means, while in said learning mode, comprises means for writing into said storing means at least one permitted keypad type security code sequence and at least one permitted stored code type security code sequence.

6. The system of claim 4 wherein both said keypad type security code sequence and said stored code type security code sequence comprise the same predetermined number of code words; and said means for determining the type of door open request received comprises means for analyzing a predetermined code word of each received door open request.

7. A remote garage door opening receiver for selectively generating door actuation signals responsive to transmitted door open requests of a stored code type, each stored code type door open request comprising a stored code generated security code sequence and having stored code type indicia and of a keypad type, each keypad type door open request comprising a keypad generated security code sequence and having keypad type indicia, said receiver comprising:

means at all times capable of receiving door open requests of both said stored code type and said keypad type;

determining means responsive to the keypad type indicia of a received keypad type door open request for determining that the received door open request is a keypad type door open request, and a responsive to the stored code type indicia of a received stored code type door open request for determining that the received door open request is a stored code type door open request;

security control means responsive to operator action for selectively generating one of a first signal indicative of door actuation in response to received stored code type door open requests and to received keypad type door open requests, and a second signal indicative of door actuation in response to only received keypad type door open requests; and door actuation signal generating means for storing a stored code type security code sequence and a keypad type security code sequence, for selectively generating door actuation signals responsive to received door open requests of both said stored code type and said keypad type when said security control means is generating said first signal and for selectively generating door actuation signals only in response to door open requests of said keypad type when said security control means is generating said second signal.

8. The receiver of claim 7 wherein said security control means selectively generates a third signal indicative of a locked door and said door actuation signal generating means comprises means responsive to said third signal of said security control means for inhibiting the generation of door actuation signals.

9. The receiver of claim 7 wherein said door actuation signal generating means comprises means for comparing received stored code type door open requests with said stored code type security code sequences and for comparing received keypad type door open requests with said stored keypad type security code sequences.

10. A garage door opening apparatus for the selective generation of actuation signals responsive to keypad type security code sequences, each keypad type security code sequence including keypad transmitter indicia identifying a keypad type transmitter and stored code type security code sequences, each stored code type security sequence including stored code transmitter indicia identifying a stored code type transmitter received by a receive means capable at all times of receiving security code sequences of both said keypad type and said stored code type, said method comprising:

identifying at said apparatus one of a first mode of operation in which actuation signals are to be generated responsive to both keypad type security code sequences and stored code type security code sequences and a second mode of operation in which actuation signals are to be generated responsive only to received keypad type security code sequences;

receiving a security code sequence by said receive means;

determining from the keypad transmitter indicia of a received keypad type security code sequence that a keypad type security code sequence was received and determining from the stored code transmitter indicia of a received stored code type security code sequence that a stored code type security code sequence was received;

selectively generating actuation signals responsive to said received security code regardless of the type of said received security code sequence when said first mode of operation is identified in said identifying step; and selectively generating actuation signals only in response to received security code sequences determined by the determining step to be keypad type security code sequences when said second mode of operation is identified in said identifying step.

* * * * *

UNITED STATES PATENT AND TRADEMARK OFFICE

CERTIFICATE OF CORRECTION

PATENT NO. : 5,576,701

DATED : Nov. 19, 1996

INVENTOR(S) : Heitschel et al.

It is certified that error appears in the above-indentified patent and that said Letters Patent is hereby corrected as shown below:

Claim 4, column 12, line 41, change "store dine" to --stored in--.

Claim 4, column 12, line 53, before "stored", insert --a--.

Claim 7, column 13, line 14, after "and" delete --a--.

Signed and Sealed this

Twenty-second Day of April, 1997

Bruce Lehman

BRUCE LEHMAN

*Commissioner of Patents and Trademarks*

*Attest:*

*Attesting Officer*